US008279156B2

(12) United States Patent
Wang

(10) Patent No.: US 8,279,156 B2
(45) Date of Patent: Oct. 2, 2012

(54) OUTPUT AMPLIFIER OF SOURCE DRIVER WITH HIGH IMPEDANCE AND INVERTED HIGH IMPEDANCE CONTROL SIGNALS

(75) Inventor: Chen-Yu Wang, Sinshih Township, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 452 days.

(21) Appl. No.: 12/577,931

(22) Filed: Oct. 13, 2009

(65) Prior Publication Data

US 2011/0084945 A1 Apr. 14, 2011

(51) Int. Cl.
*G09G 3/36* (2006.01)

(52) U.S. Cl. ..... 345/100

(58) Field of Classification Search ..... 257/159; 307/417, 418; 315/403; 345/100
See application file for complete search history.

(56) References Cited

U.S. PATENT DOCUMENTS

| | | | | |
|---|---|---|---|---|
| 7,397,287 | B2 * | 7/2008 | Makihara | 327/91 |
| 2005/0264548 | A1 * | 12/2005 | Okamura et al. | 345/204 |
| 2009/0096505 | A1 * | 4/2009 | Wolters et al. | 327/518 |
| 2009/0244056 | A1 * | 10/2009 | Tsuchi | 345/214 |
| 2009/0295780 | A1 * | 12/2009 | Shimizu et al. | 345/213 |

* cited by examiner

*Primary Examiner* — Chanh Nguyen
*Assistant Examiner* — Jonathan Blancha
(74) *Attorney, Agent, or Firm* — Thomas, Kayden, Horstemeyer & Risley, LLP

(57) ABSTRACT

An output amplifier includes an amplifier circuit, an output stage circuit, a first switch transistor, and a second switch transistor. The amplifier circuit is used for amplifying an input pixel signal to generate the inverted signal and the non-inverted signal. The output stage circuit has a first output terminal for passing a supply voltage from a supply terminal or passing a ground voltage from a ground terminal to the pixel circuit according to the inverted signal and the non-inverted signal. The first switch transistor passes or blocks the supply voltage according to a high impedance signal, and the second switch transistor passes or blocks the ground voltage according to the inverted high impedance signal.

11 Claims, 3 Drawing Sheets

OUTPUT AMPLIFIER OF SOURCE DRIVER WITH HIGH IMPEDANCE AND INVERTED HIGH IMPEDANCE CONTROL SIGNALS

BACKGROUND

1. Field of Invention

The disclosure relates to an output amplifier. More particularly, the disclosure relates to the output amplifier of a source driver for driving a display panel.

2. Description of Related Art

In general, a liquid crystal display usually includes a source driver for driving source lines (or column lines) in order to drive the LCD panel. The source driver provides source driving signals or input pixel signals to each of the source lines in order to indicate the color/data in the respective source lines, and displays a picture in an LCD.

Since most source drivers are used in portable devices such as the laptop computers or the notebooks, and these portable devices usually work in low analog power, therefore, reduction in power consumption becomes a very important issue. However, source driver having the output amplifier manufactured in high voltage process (ex. 12V) can hardly work in low analog power due to body effect of the transistor employed in the out amplifier.

The body effect is the threshold voltage variation raised by the change in the source-bulk (body) voltage, in other words, if the source and the body of the transistor are not connected together, the body effect problem appears, and the equivalent resistance of the transistor is raised. The body effect can be approximated by the following equation:

$$V_{TN}=V_{T0}+\gamma(\sqrt{V_{SB}+2\phi}-\sqrt{2\phi}),$$

where $V_{SB}$ is the voltage drop between the source and the body of the transistor, $V_{T0}$ is threshold voltage when $V_{SB}$ is zero, $V_{TN}$ is the result threshold voltage with substrate bias present, $\gamma$ is the body effect parameter, and $2\phi$ is the surface potential parameter. Because the body can be operated as a second gate, and is sometimes referred to as the "back gate", the body effect is sometimes called the "back-gate effect".

Due to the body effect, the driving ability of the output amplifier is weakened, and the driving ability of the output amplifier is even worse when the analog power is reduced, which might not be able to drive the pixel circuit.

Therefore, there is a need for a new output amplifier which can preserve the driving ability to drive the pixel circuit.

SUMMARY

According to one embodiment of the present invention, an output amplifier of a source driver, driving a pixel circuit of a panel, includes an amplifier circuit, an output stage circuit, a first switch transistor, and a second switch transistor. The amplifier circuit has an inverting terminal for providing an inverted signal, and has a non-inverting terminal for providing a non-inverted signal, in which the amplifier circuit is used for amplifying an input pixel signal to generate the inverted signal and the non-inverted signal. The output stage circuit has a first output terminal for passing a supply voltage from a supply terminal or passing a ground voltage from a ground terminal to the pixel circuit according to the inverted signal and the non-inverted signal.

The first switch transistor has a source and a body both electrically connected to the supply terminal, and has a drain electrically connected to the output stage circuit, in which the first switch transistor passes or blocks the supply voltage according to a high impedance signal. The second switch transistor has a source and a body both electrically connected to the ground terminal, and has a drain electrically connected to the output stage circuit, in which the second switch transistor passes or blocks the ground voltage according to the inverted high impedance signal.

It is to be understood that both the foregoing general description and the following detailed description are by examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
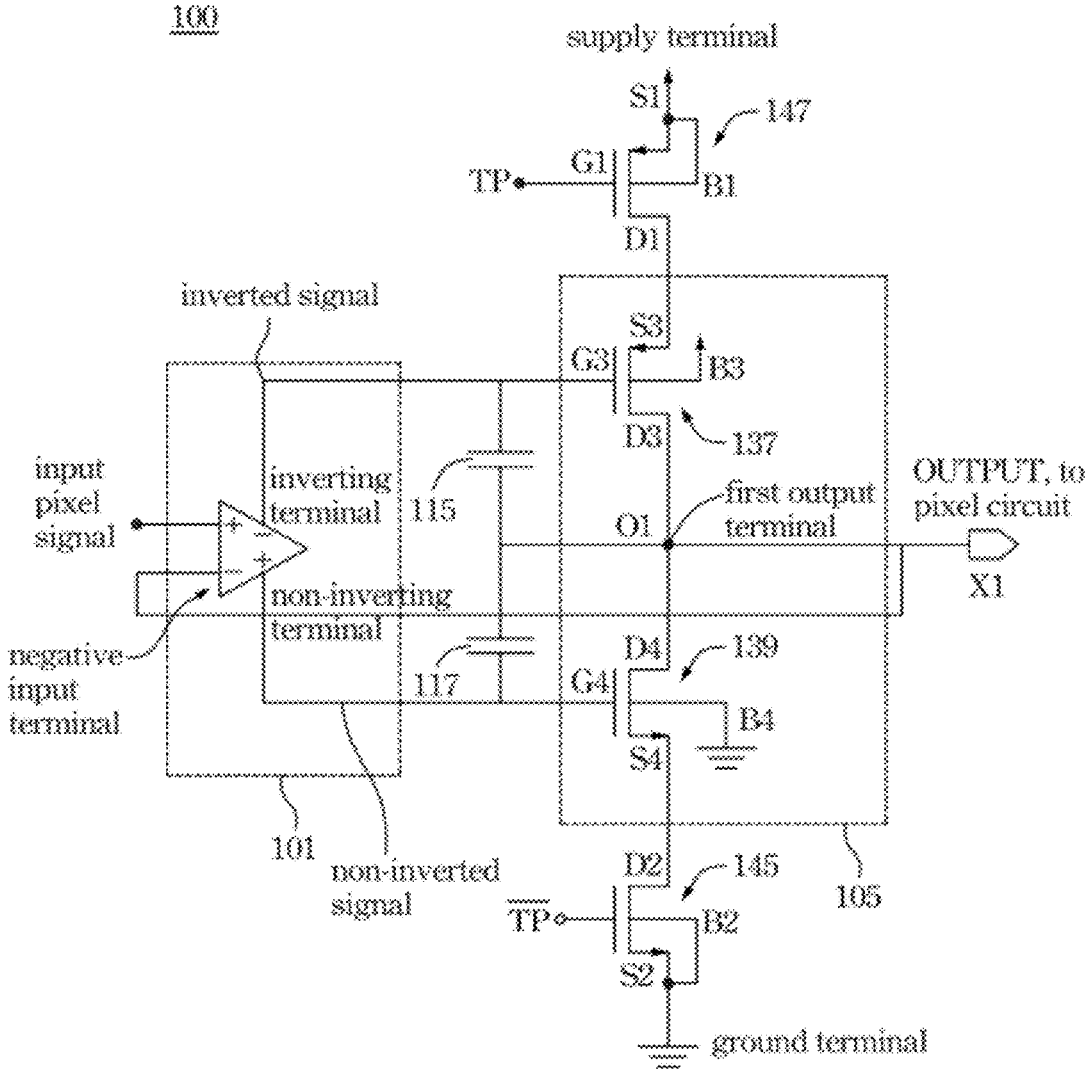
FIG. 1 shows the output amplifier of a source driver driving a pixel circuit of a panel according to one embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

The high impedance control switch employed in the output amplifier (also called as the transmission gate having a PMOS and a NMOS connected in parallel) in the following embodiments has been moved from somewhere between the pixel circuit and the source driver to the supply terminal (or the ground terminal), which reduces the body effect of the output amplifier. Therefore, driving ability of the output amplifier is improved.

FIG. 1 shows the output amplifier of a source driver driving a pixel circuit of a panel according to one embodiment of the present invention. The output amplifier 100 includes an amplifier circuit 101, an output stage circuit 105, a first switch transistor 147, and a second switch transistor 145, in which the first switch transistor 147 and the second switch transistor 145, having been disposed between the first output terminal O1 and the OUTPUT X1 previously, are moved and placed adjacent to the supply terminal and the ground terminal, respectively.

The amplifier circuit 101, such as the operation amplifier, has an inverting terminal (−) for providing an inverted signal, and has a non-inverting terminal (+) for providing a non-inverted signal, in which the amplifier circuit 101 is used for amplifying an input pixel signal to generate the inverted signal and the non-inverted signal. The output stage circuit 105 has the first output terminal O1 for passing the supply voltage from the supply terminal, or passing a ground voltage from the ground terminal to the pixel circuit according to the inverted signal and the non-inverted signal.

The first switch transistor 147, such as a PMOS, has a source S1 and a body B1 both electrically connected to the supply terminal, and has a drain D1 electrically connected to the output stage circuit 105. The second switch transistor 145, such as a NMOS, has a source S2 and a body B2 both electrically connected to the ground terminal, and has a drain D2 electrically connected to the output stage circuit 105. In the output amplifier 100 of this embodiment, the first switch transistor 147 and the second switch transistor 145 do not receive any signal directly from the amplifier circuit 101.

The first switch transistor 147 passes or blocks the supply voltage according to a high impedance signal TP, and the second switch transistor 145 passes or blocks the ground voltage according to the inverted high impedance signal $\overline{TP}$, in which the high impedance signal TP represents that the interconnect terminal X1 connecting the pixel circuit and output amplifier 100 is in high impedance status. When the interconnect terminal X1 is in high impendance status, the pixel circuit receives no signals from the output amplifier 100 of the source driver.

As mentioned above, the first switch transistor 147 and the second switch transistor 145 have their bodies electrically connected to their sources, and the body effect of these transistors can be eliminated. As a result, the threshold voltage and the equivalent resistance of these transistors keep the same without increasing, and the driving ability of the output amplifier for driving the pixel circuit maintains the same even the output amplifier is operated by low voltage level.

The output stage circuit 105 includes a third transistor 137 and a fourth transistor 139. The third transistor 137, such as a PMOS, has a gate G3 electrically connected to the inverting terminal (−) of the amplifier circuit 101, and has a source S3 electrically connected to the drain D1 of the first switch transistor 147. The fourth transistor 139, such as a NMOS, has a gate G4 electrically connected to the non-inverting terminal (+) of the amplifier circuit 101, has a drain D4 electrically connected to the drain D3 of the third transistor 137, and has a source S4 electrically connected to the drain D2 of second switch transistor 145.

When the first switch transistor 147 and the second switch transistor 145 are turned on (conductive), the resistances of the first switch transistor 147 and the second switch transistor 145 are small (like a conducting wire), so the sources of the third transistor 137 and the fourth transistor 139 are substantially connected to the supply terminal and the ground terminal respectively. Therefore, the third transistor 137 can have both its body and source receiving the supply voltage, and the fourth transistor 139 can also have both its body and source receiving the ground voltage. Since the body and the source of the third transistor 137 or the fourth transistor 139 are connected together, the body effect of these transistors are eliminated, too.

The output amplifier 100 further includes the first capacitor 115 and the second capacitor 117 electrically connected to the output stage circuit 105. The first capacitor 115, electrically connected between the inverting terminal (−) and the negative input terminal (−) of the amplifier circuit 101 through the first output terminal O1, maintains the voltage drop between the inverting terminal (−) and the negative input terminal (−). The second capacitor 117, electrically connected between the non-inverting terminal (+) and the negative input terminal (−) of the amplifier circuit 101, maintains the voltage drop between the non-inverting terminal (+) and the negative input terminal (−).

Figure 2:
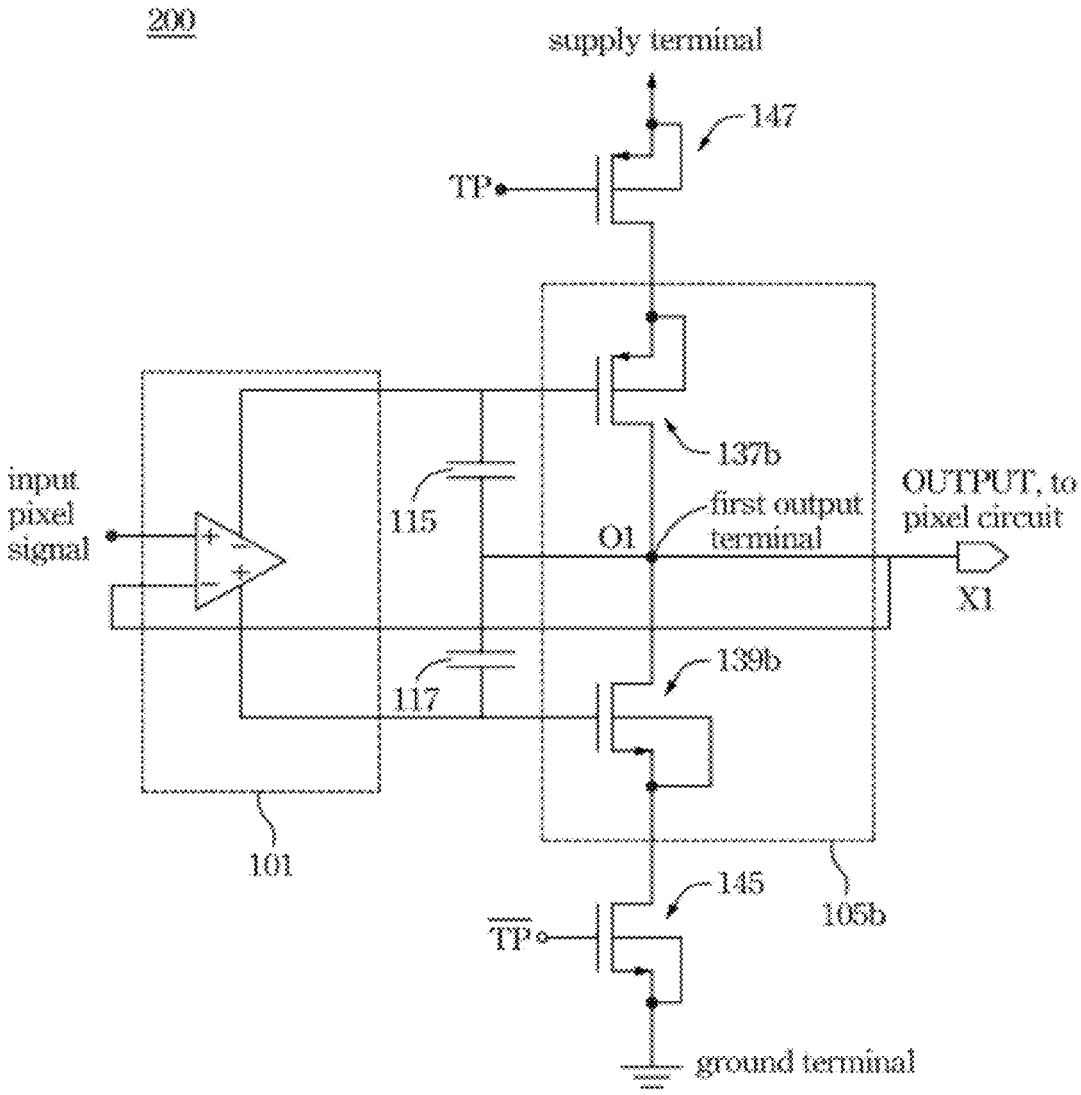
FIG. 2 shows the output amplifier of a source driver driving a pixel circuit of a panel according to another embodiment of the present invention.

FIG. 2 shows the output amplifier of a source driver driving a pixel circuit of a panel according to another embodiment of the present invention. The output amplifier 200 includes the amplifier circuit 101, the output stage circuit 105*b*, a first switch transistor 147, and a second switch transistor 145, in which the first switch transistor 147 and the second switch transistor 145, disposed between the first output terminal D1 and the OUTPUT X1 previously, have been moved and placed adjacent to the supply terminal and the ground terminal, respectively.

The configuration and the operation of the output amplifier 200 are similar to the output amplifier 100 shown in FIG. 1, except that the third transistor 137*b* and the fourth transistor 139*b* of the output stage circuit 105*b* have their bodies connected to their sources, in order to eliminate the body effect problem.

Figure 3:
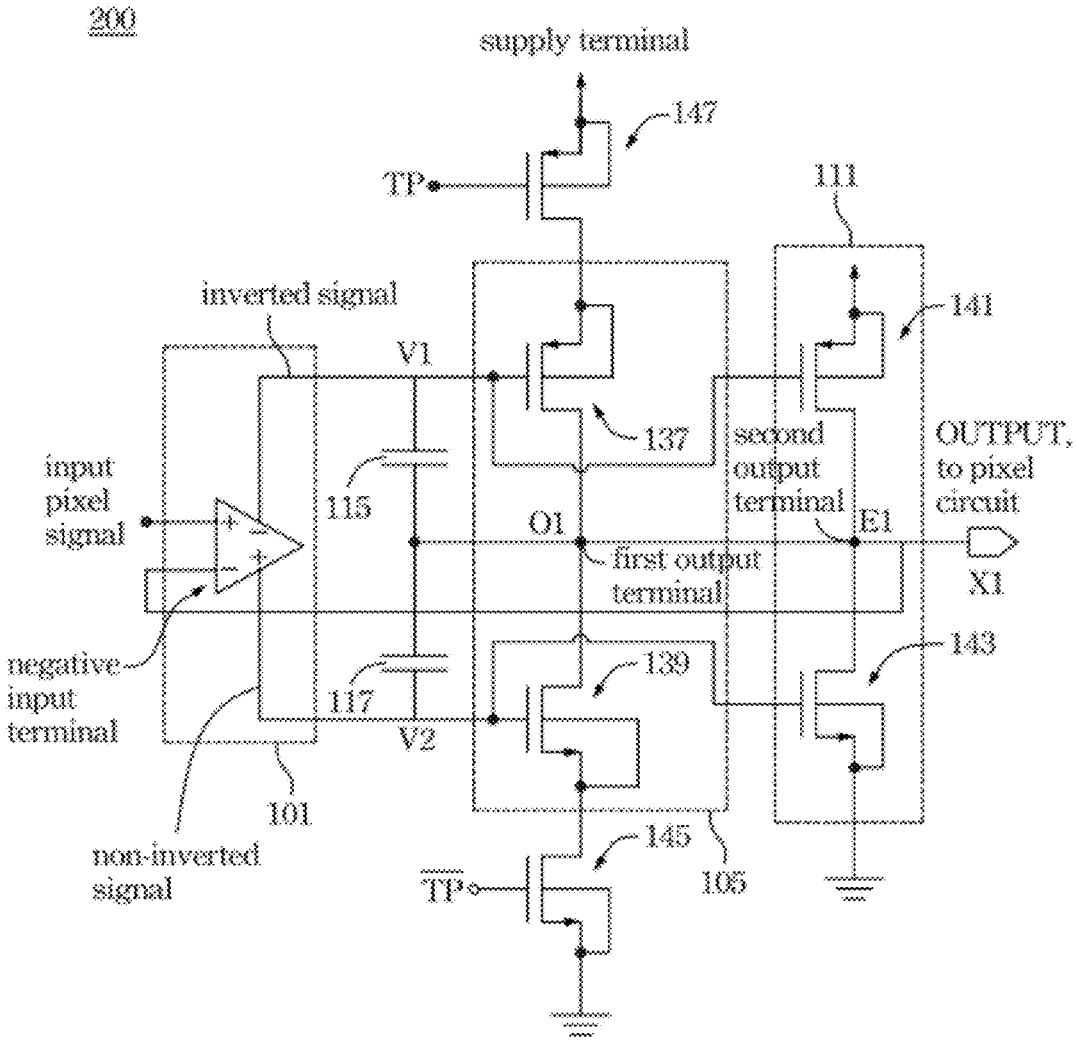
FIG. 3 shows the output amplifier of a source driver driving a pixel circuit of a panel according to yet another embodiment of the present invention.

FIG. 3 shows the output amplifier of a source driver driving a pixel circuit of a panel according to yet another embodiment of the present invention. In this embodiment, an additional driving stage circuit 111 is employed, while the amplifier circuit 101, the output stage circuit 105, the first switch transistor 147, the second switch transistor 145, the first capacitor 115 and the second capacitor 117 are configured and operated similar to those shown in FIG. 1.

The driving stage circuit 111 providing a second output terminal E1 to drive the pixel circuit, in which the driving stage circuit 111 passes the supply voltage or the ground voltage to the pixel circuit. Therefore, the pixel circuit is driven by both the output stage circuit 105 and the driving stage circuit 111, which improves the driving ability of the output amplifier to drive the pixel circuit.

The negative input terminal (−) of the amplifier circuit 101 is electrically connected to the first output terminal O1 and the second output terminal E1, such that the voltage levels on the negative input terminal (−), the first output terminal O1 and the second output terminal E1 are the same. The driving stage circuit 111 includes a fifth transistor 141 and a sixth transistor 143. The fifth transistor 141 has a gate receiving the inverted signal, and has a source receiving the supply voltage. The sixth transistor 143 has a gate receiving non-inverted signal, has a drain electrically connected to the drain of the fifth transistor 141, and has a source receiving the ground voltage.

According to the above embodiments, the high impedance control switch, including a PMOS transistor and a NMOS transistor, has been moved from somewhere between the output amplifier and the pixel circuit to the supply/ground terminal, such that the body effect of the transistors employed in the high impedance control switch can be eliminated; meanwhile, the high impedance control switch can still put the pixel circuit in high impedance status according to the high impedance signal.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An output amplifier of a source driver driving a pixel circuit of a panel, the output amplifier comprising:

an amplifier circuit comprising an inverting terminal for providing a inverted signal, and comprising a non-inverting terminal for providing a non-inverted signal, wherein the amplifier circuit is used for amplifying an input pixel signal to generate the inverted signal and the non-inverted signal;

an output stage circuit comprising a first output terminal for passing a supply voltage from a supply terminal or passing a ground voltage from a ground terminal to the pixel circuit according to the inverted signal and the non-inverted signal;

a first switch transistor having a source and a body both electrically connected to the supply terminal, and having a drain electrically connected to the output stage circuit, wherein the first switch transistor passes or blocks the supply voltage according to a high impedance signal; and a second switch transistor having a source and a body both electrically connected to the ground terminal, and having a drain electrically connected to the output stage circuit, wherein the second switch transistor passes or blocks the ground voltage according to an inverted high impedance signal.

2. The output amplifier of the source driver as claimed in claim 1, wherein the high impedance signal represents whether an interconnect terminal connecting between the pixel circuit and the output amplifier is high impedance.

3. The output amplifier of the source driver as claimed in claim 1, wherein the first switch transistor and the second switch transistor do not receive signal directly from the amplifier circuit.

4. The output amplifier of the source driver as claimed in claim 1, wherein the output stage circuit further comprises:

a third transistor having a gate electrically connected to the inverting terminal of the amplifier circuit, and having a source electrically connected to the drain of the first switch transistor; and a fourth transistor having a gate electrically connected to the non-inverting terminal of the amplifier circuit, having a drain electrically connected to a drain of the third transistor, and having a source electrically connected to the drain of the second switch transistor.

5. The output amplifier of the source driver as claimed in claim 4, wherein the third transistor has a body electrically connected to the source of the third transistor, and the fourth transistor has a body electrically connected to the source of the fourth transistor.

6. The output amplifier of the source driver as claimed in claim 4, wherein the third transistor has a body electrically connected to the supply terminal, and the fourth transistor has a body electrically connected to the ground terminal.

7. The output amplifier of the source driver as claimed in claim 1, further comprising a driving stage circuit providing a second output terminal to drive the pixel circuit, wherein the driving stage circuit passes the supply voltage or the ground voltage to the pixel circuit.

8. The output amplifier of the source driver as claimed in claim 7, wherein the driving stage circuit further comprises:

a fifth transistor having a gate receiving the inverted signal, and having a source receiving the supply voltage; and a sixth transistor having a gate receiving the non-inverted signal, having a drain electrically connected to a drain of the fifth transistor, and having a source receiving the ground voltage.

9. The output amplifier of the source driver as claimed in claim 8, wherein the amplifier circuit further comprises a negative input terminal electrically connected to the first output terminal and the second output terminal, whereby the voltage levels on the negative input terminal, the first output terminal and the second output terminal are the same.

10. The output amplifier of the source driver as claimed in claim 9, further comprising:

a first capacitor, electrically connected between the inverting terminal and the negative input terminal of the amplifier circuit, for maintaining the voltage drop between the inverting terminal and the negative input terminal; and a second capacitor, electrically connected between the non-inverting terminal and the negative input terminal of the amplifier circuit, for maintaining the voltage drop between the non-inverting terminal and the negative input terminal.

11. The output amplifier of the source driver as claimed in claim 1, wherein the amplifier circuit is an operation amplifier comprising the inverting terminal for providing the inverted signal, and comprising the non-inverting terminal for providing the non-inverted signal.

* * * * *